US005392565A

United States Patent [19]

Rentschler

[11] Patent Number: 5,392,565

[45] Date of Patent: Feb. 28, 1995

[54] DOOR FRAME AND GUSSET SYSTEM

[75] Inventor: William J. Rentschler, Abbeville, Ala.

[73] Assignee: Dunbarton Corporation, Dothan, Ala.

[21] Appl. No.: 210,685

[22] Filed: Mar. 18, 1994

[51] Int. Cl.[6] ..... E06B 1/04

[52] U.S. Cl. ..... 49/504; 49/381

[58] Field of Search ..... 49/504, 505, 382, 381; 52/204.1, 210, 212, 213, 211

[56] References Cited

U.S. PATENT DOCUMENTS

| | | | |
|---|---|---|---|
| 2,666,945 | 1/1954 | Kelly | 49/382 X |
| 2,853,162 | 9/1958 | David et al. | 49/382 |
| 3,263,368 | 8/1966 | Hildum et al. | 49/382 |
| 4,635,399 | 1/1987 | Gehrke et al. | 49/504 X |
| 5,154,019 | 10/1992 | Day | 49/504 |

*Primary Examiner*—Philip C. Kannan

*Attorney, Agent, or Firm*—Jones & Askew

[57] ABSTRACT

A door frame and gusset system for attaching a hinge for supporting a door. The door frame includes an emboss indentation having a universal set of openings which can match a plurality of different screw hole patterns for hinges.

4 Claims, 4 Drawing Sheets

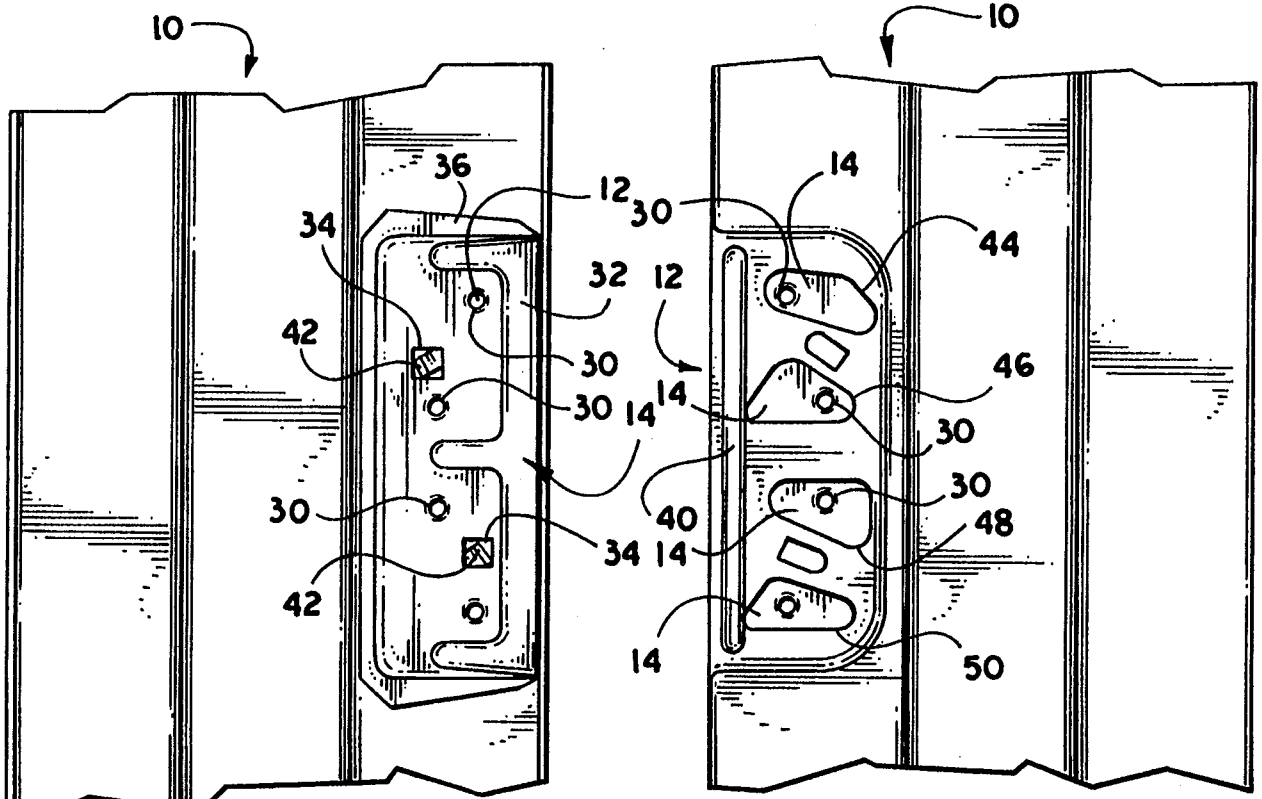
Fig. 7
Fig. 6
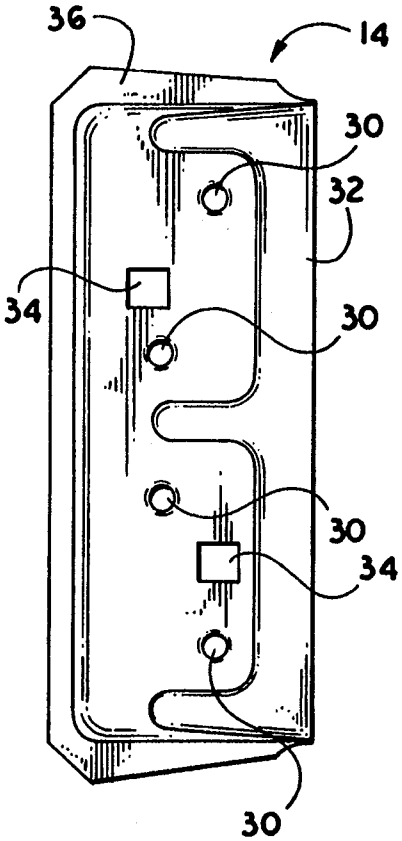
Fig. 5

DOOR FRAME AND GUSSET SYSTEM

TECHNICAL FIELD OF THE INVENTION

This invention relates in general to a door frame and gusset system, and more specifically relates to a door frame and gusset system for attaching a hinge to a door, the hinge having any one of a variety of different screw hole patterns.

BACKGROUND OF THE INVENTION

Traditionally, doors are hung on wooden door frames by inserting screws through hinges into the wood surrounding the door. Newer, industrial constructions, however, typically use metal door frames. The frames are often thin-walled and hollow, and thus do not have a solid background material for inserting a screw.

Typically, manufacturers use gussets behind a door frame for receiving the screws and supporting the hinge and door. These gussets usually comprise a small plate of metal which is thicker than the door frame and which has casted or machined in its side screw holes which match the pattern of screw holes on the hinges. The holes in the gusset are tapped to receive the screws holding the door hinge.

The door frames generally include an indentation (called "emboss indentation" in the art) for receiving the hinge from the door. A gusset is generally attached or held in place against the back of this emboss indentation, before the frame is attached, by some form of tab, which is inserted into the gusset when the gusset is in place. Holes are included in the emboss indentation which match the screw hole pattern on the hinge and the gusset and which are aligned with the screw holes on the gusset when the gusset is placed on the tabs. After the gusset is in place, the door frame is attached to the wall. The door frame then stands ready for the attachment of a door, which simply requires inserting a screw through the hinge, through the hole in the door frame, and into the gusset.

The problem with the gusset systems of the prior art is that several manufacturers, including the assignee of the present application, each use different hole patterns for their hinges and gussets. Thus, the gussets, emboss indentations, and hinges must have matching patterns for the holes. If a contractor works with several different manufacturers, he must carry a variety of different door frames, in addition to a large quantity of different gussets. Although stocking several gussets is generally not that much of a problem, the size and weight of door frames makes stocking a large number of door frames inconvenient and costly.

SUMMARY OF THE INVENTION

The present invention solves the above problems by providing a universal opening pattern on the emboss indentations which allows the use of numerous manufacturers' screw hole patterns to be used on a single emboss indentation. The invention allows a contractor to inventory a minimum number of door frames.

More specifically stated, the present invention provides a door frame and gusset system for attaching a hinge for supporting a door. An emboss indentation is formed in the door frame, the emboss indentation for receiving a frame leaf of the door hinge, the frame leaf including a plurality of screw holes of one of a plurality of screw hole patterns. The indentation includes a universal pattern of openings. The system also includes a gusset that is received within the metal frame behind the emboss indentation. The gusset has a plurality of threaded holes which match the screw holes in the frame leaf. Each of the openings in the emboss indentation extend in an oblong direction on the emboss indentation such that the universal pattern of openings on the emboss indentation may match with any one of the plurality of set patterns of the holes for the door hinges.

Therefore, it is an object of the present invention to provide an improved door frame and gusset system.

It is a further object of the present invention to provide a door frame and gusset system which includes an emboss indentation which may fit a variety of different hole patterns for different hinges.

Further objects, features and advantages will become apparent upon consideration of the following detailed description of the invention when taken in conjunction with the drawing and the appended claims.

BRIEF DESCRIPTION OF THE DRAWINGS

FIG. 5 is a back view of the gusset of FIG. 4

FIG. 6 is a back view of the door frame and emboss indentation of FIG. 3, with the gusset of FIG. 4 in place.

FIG. 7 is a front view of the door frame and gusset of FIG. 6.

DETAILED DESCRIPTION OF THE PREFERRED EMBODIMENT

Figure 1:
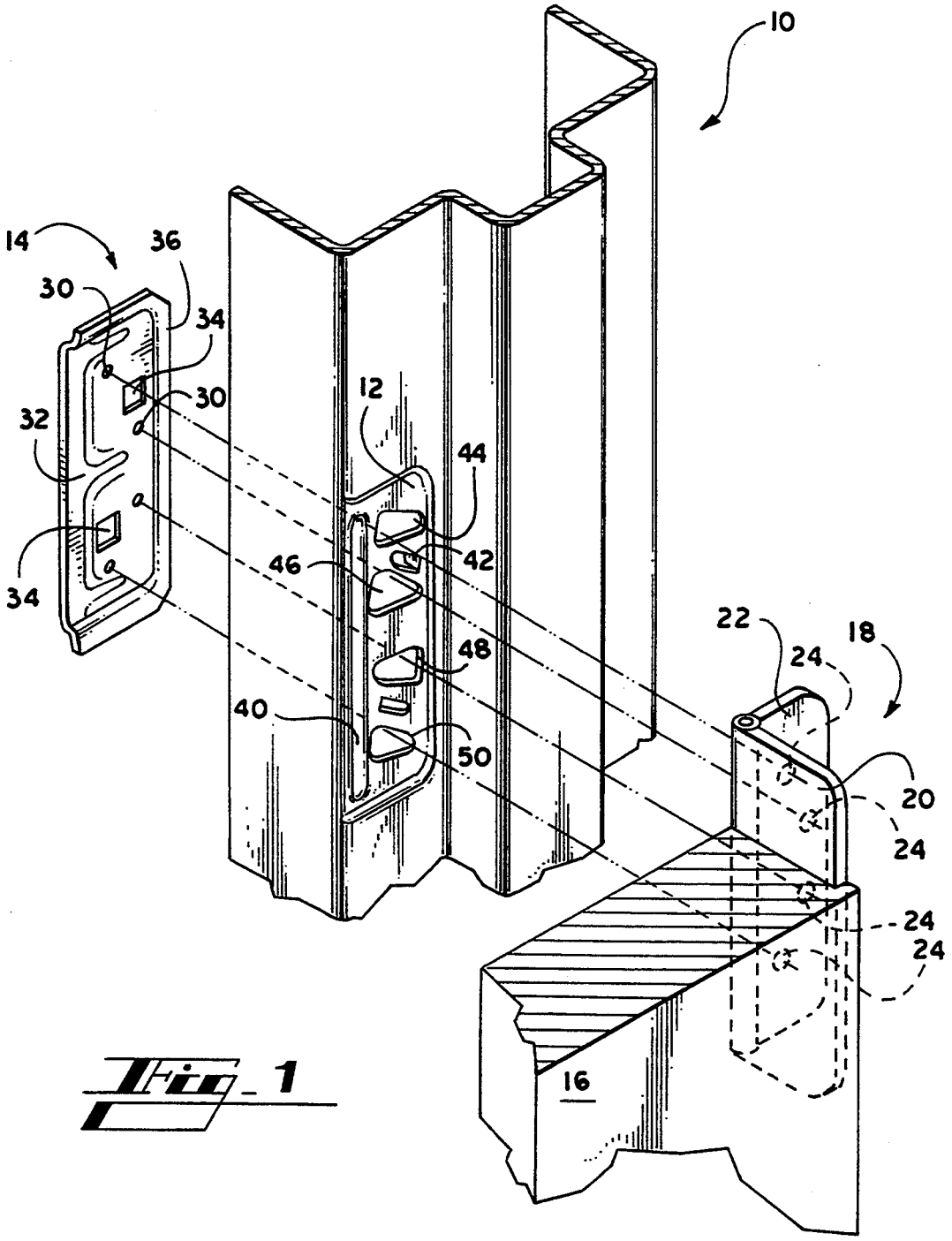
FIG. 1 discloses an exploded perspective view of a door frame and gusset system embodying the present invention.

Referring now to the drawing, in which like reference numerals represent like parts throughout the several views, FIG. 1 discloses a door frame 10 having an emboss indentation 12 embodying the present invention. A gusset 14 is configured to be received within the door frame 10 behind the emboss indentation 12. A door 16 for attachment to the door frame 10 is also pictured in FIG. 1. The door includes a hinge 18, having a center leaf 20 which is attached to the door and a frame leaf 22 which fits within the indentation 12 of the door frame 10. A plurality of screw holes 24 are included on the frame leaf 22. These screw holes 24 may be arranged in one of many patterns depending on the pattern adopted by the particular manufacturer of the hinge.

Figure 4:
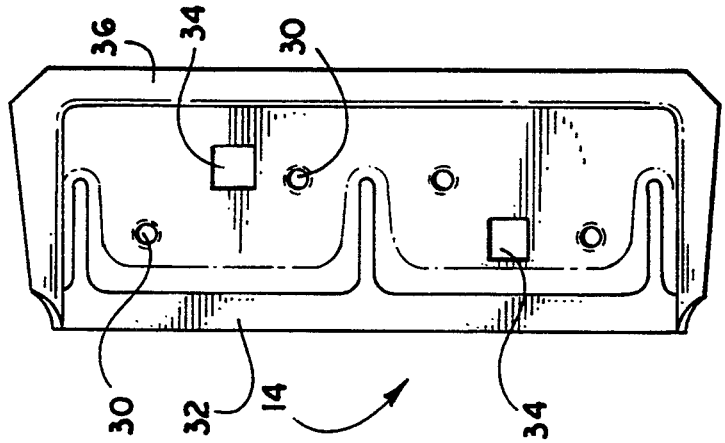
FIG. 4 is a front view of a gusset embodying the present invention.

As can be seen in FIG. 4, the gusset 14 includes a plurality of threaded holes 30, the pattern of which match the pattern of screw holes 24 in the frame leaf 22. The gusset 14 also includes a ridge 32 extending lengthwise along one side. The other three sides of the gusset are rounded and extend down to a flange 36. Two apertures 34 are included on the gusset 14, the function of which will be explained below.

Figure 2:
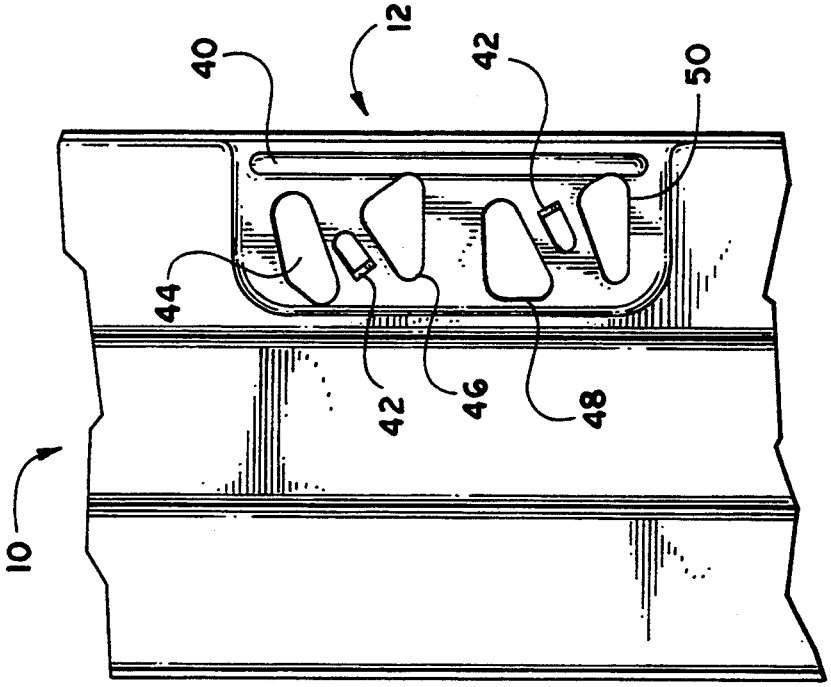
FIG. 2 is a back view of a door frame and emboss indentation of the present invention.

The emboss indentation 12 is shown from a rear view in FIG. 2. The emboss indentation 12 includes a rib 40. Tabs 42 are punched from the metal forming the emboss indentation and are bent rearwardly (out of the page in FIG. 3). The emboss indentation 12 includes four openings 44, 46, 48, 50 which extend partially transversely across the emboss indentation 12 and are oblong in shape.

Figure 3:
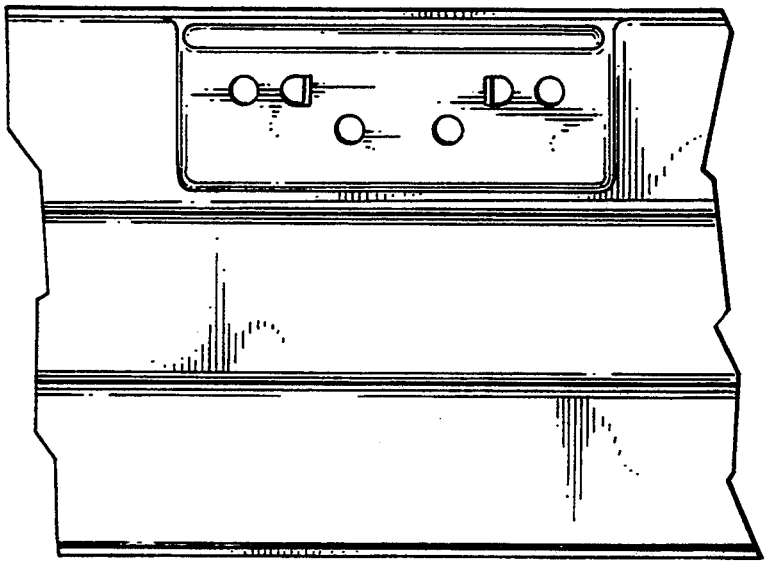
Fig. 3 (PRIOR ART)
FIG. 3 is a back view of a door frame and emboss indentation of the prior art.

As can be seen in FIG. 6, the gusset 14 fits onto the back side of the emboss indentation 12 of the door frame 10. The ridge 32 which extends down one side of the gusset 14 is configured to engage the rib 40 of the door frame 10. The labs 42 on the emboss indentation 12 extend through the apertures 34 when the gusset 14 is placed into position adjacent the emboss indentation 12 of the door frame 10. The flange 36 of the gusset 14 is seated in place on the inner side of the frame 10. As can be seen in FIG. 7, when the gusset 12 is seated in place on the rearward side of the emboss indentation 12, the threaded holes 30 on the gusset 14 are exposed to the front side of the frame 10 through the openings 44, 46, 48, 50. The openings 44, 46, 48, 50 allow a large number of different screw hole patterns to be used with the emboss indentation 12, in contrast to the prior art models, such as is shown in FIG. 3, in which a door frame and emboss indentation would fit only one screw hole pattern of the door hinge.

To maximize the strength of the emboss indentation 12, it is necessary to minimize the surface area removed by the openings 44, 46, 48, and 50. The openings are designed to fit a large number of hinge screw hole patterns which include four screw holes. Thus, to minimize the area of the openings 44, 46, 48, and 50, and to accommodate all of the screw patterns known, an oblong shape is ideal. It has been found that the largest discrepancy in lateral positioning of the screw holes occurs to the far right in FIG. 7 on openings 44 and 48, and to the far left on openings 46 and 50. Little or no discrepancy occurs in screw holes located at opposite ends of these openings. It is preferred that the openings be ovate and inverted with respect to the next adjacent opening. Thus, the broad, rounded end of one of the openings would be at the same side of the emboss indentation 12 as the tapered end of an adjacent opening.

Figure 9:
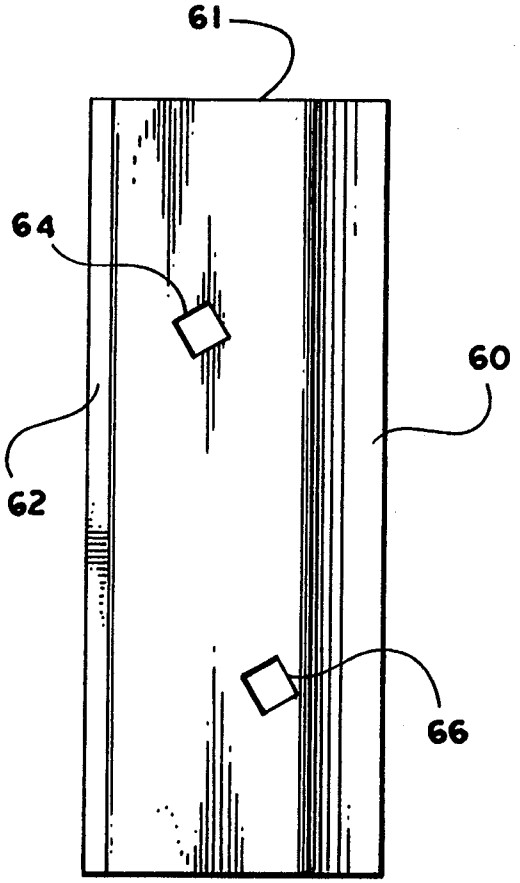
FIG. 9 is a back view of the gusset of FIG. 8.
Figure 8:
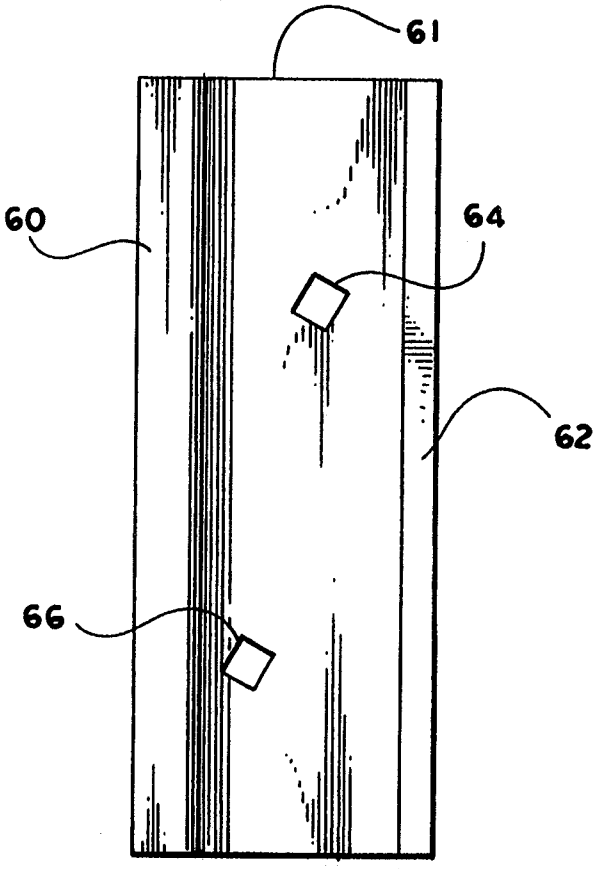
FIG. 8 is a front view of an alternative gusset embodying the present invention.

An alternative embodiment of a gusset 61 (shown in FIGS. 8 and 9) for the present invention includes an upper ridge 60 which is configured to extend over the rib 40 of the emboss indentation 12. A second ridge 62, configured to extend downwardly, is included on the opposite side of the gusset. The ridges are not set to engage the surface of the door frame 10 or the rib 40, but instead serve as beam strength for the gusset. The gusset may be supplied with screw holes to match any of one of a set of patterns. Openings 64 and 66 are included for receiving the tabs 42 in FIG. 2. The gusset 61 described is much less difficult and expensive to fabricate than the gusset 14, yet has similar strength characteristics.

As can be understood from the foregoing, the present invention provides a universal emboss indentation 12 in the door frame 10 which is configured to be used with many different screw hole patterns for hinges and gussets. Although the gussets and hinges will be different for each of these sets, the door frame for all of them can be the same. This allows a contractor to inventory and supply only one type of door frame, as opposed to many door frames with a number of different patterns, saving inventory space and preventing possible down time.

While this invention has been described with reference to preferred embodiments thereof, it is to be understood that variations and modifications can be affected within the spirit and scope of the invention as described herein and before and as described in the appended claims.

I claim:

1. A door frame and gusset system for attaching a hinge for supporting a door, the system comprising:

a. a metal door frame;

b. an emboss indentation in the door frame, the emboss indentation for receiving a frame leaf of the door hinge, the frame leaf including a plurality of screw holes of one of a plurality of set patterns for screw holes, the indentation comprising a universal pattern of openings, each of the openings in the emboss indentation being oblong in configuration and extending in a transverse direction on the emboss indentation such that the universal pattern of openings on the emboss indentation may match with any one of the plurality of sets of patterns for the holes for the door hinges; and c. a gusset for being received within the metal frame behind the emboss indentation, the gusset having a plurality of threaded holes which match the screw holes in the frame leaf of the hinge.

2. The door frame and gusset system of claim 1, wherein the emboss indentation further comprises a tab extending rearwardly from the emboss indentation, and the gusset further comprises an aperture for receiving the tab, whereby placing the gusset on the emboss indentation and matching the aperture on the gusset with the tab on the emboss indentation causes the plurality of threaded holes on the gusset to be aligned properly with the plurality of openings on the emboss indentation such that when the frame leaf is placed in the front side of the emboss indentation, the plurality of screw holes in the frame leaf match the plurality of threaded holes on the gusset through the openings.

3. The door frame and gusset system of claim wherein the openings are ovate.

4. The door frame and gusset system of claim 3, wherein the openings are inverted with respect to one another such that the broad, rounded end of one opening is adjacent to the tapered end of an adjacent opening.

* * * * *